United States Patent [19]

Steele

[11] 4,349,448

[45] Sep. 14, 1982

[54] LOW TEMPERATURE LOW FOAMING ALKALINE CLEANER AND METHOD

[75] Inventor: Duane C. Steele, Sterling Heights, Mich.

[73] Assignee: Hooker Chemicals & Plastics Corp., Warren, Mich.

[21] Appl. No.: 180,999

[22] Filed: Aug. 25, 1980

[51] Int. Cl.[3] ..... C11D 1/70; C11D 1/722; C11D 3/075; C11D 3/08

[52] U.S. Cl. ..... 252/135; 134/2; 134/40; 252/156; 252/173; 252/174.14; 252/174.21; 252/174.22; 252/174.24

[58] Field of Search ..... 252/99, 135, 156, 173, 252/174.14, 174.21, 174.22, 174.18, 174.24, DIG. 1

[56] References Cited

U.S. PATENT DOCUMENTS

| | | | |
|---|---|---|---|
| 2,903,486 | 9/1959 | Brown | 560/608 |
| 3,021,372 | 2/1962 | Dupre | 560/608 |
| 3,549,539 | 12/1970 | Mallows | 252/99 |
| 3,948,819 | 4/1976 | Wilde | 252/545 |
| 4,093,417 | 6/1978 | Heinlein | 8/137 |
| 4,203,858 | 5/1980 | Chakrabarti | 252/135 |
| 4,203,872 | 5/1980 | Flanagan | 252/542 |
| 4,215,004 | 7/1980 | Borgerding | 252/156 |

OTHER PUBLICATIONS

*Antarox LF-222-Tentative Specifications* GAF Corp., New York, 1 page.

*Primary Examiner*—Dennis L. Albrecht
*Attorney, Agent, or Firm*—Richard P. Mueller; Arthur E. Kluegel

[57] ABSTRACT

Described is a low temperature low foaming alkaline cleaner composition comprising:

(a) an alkaline portion containing at least 75% by weight (PBW) of alkaline materials selected from the group consisting of alkali or alkaline earth metal borate, silicate, carbonate, hydroxide, phosphate and mixtures thereof;

(b) an ethoxylated alkyl phenol in an amount from about 0.1 to about 15 PBW; and (c) an ethoxylated and propoxylated alkyl phenol in an amount from about 1 to about 15 PBW;

wherein the sum of (a), (b) and (c) equals 100 PBW.

The compositions are useful as low temperature low foaming cleaners in solid or liquid form. A variety of oils and soaps may be removed from soiled substrates. Cleaning temperatures in the range of 60° F. and above are obtainable.

15 Claims, No Drawings

LOW TEMPERATURE LOW FOAMING ALKALINE CLEANER AND METHOD

DESCRIPTION

BACKGROUND OF THE INVENTION

The present invention is concerned with a low temperature low foaming cleaner composition. In particular, the invention is concerned with utilizing alkaline materials as highly efficient cleaners useful at temperatures as low as 60° F. (15.6° C.).

In order to obtain a highly efficient cleaner, high detergency components, such as alkaline components, are employed. In order to have a decreased cost involved in cleaning operations in the manufacturing processes followed by industry low temperatures are used. Foaming, however, is a common problem due to the use of surfactants to increase the ability of cleaners to operate at lower temperatures. However, due to the foaming problem, anti-foaming agents have been added to allow the low temperature operation to be utilized. With the addition of the anti-foaming agents, however, poor detergency has been noted. The combination of low temperature low foaming alkaline cleaners is obtainable by virtue of the present invention.

Alkaline cleaner compositions are well known as those that contain alkali or alkaline earth metal borates, silicates, carbonates, hydroxides, phosphates and mixtures thereof. It is to be appreciated that phosphate includes all the broad class of phosphate materials, such as phosphates, pyrophosphates, tetraphosphates, and the like. Silicates include all of the usual silicates used in cleaning such as metasilicates, silicates and the like. The alkali or alkaline earth metals include such components as sodium, potassium, calcium, magnesium, barium and the like. It is to be appreciated that a cleaner composition can be improved by utilizing various mixtures and ratios of the borates, hydroxides, carbonates, phosphates, silicates and the like. For appropriate end uses, one of the phosphates may be used and not a carbonate. Conversely, silicates may be used and no phosphates used depending upon the end use of the cleaner composition.

SUMMARY OF THE INVENTION

The invention is concerned with a low temperature low foaming alkaline cleaner composition comprising:

(a) an alkaline portion containing at least 75 percent by weight (PBW) of alkaline materials selected from the group consisting of alkali or alkaline earth metal borate, silicate, carbonate, hydroxide, phosphate and mixtures thereof;

(b) an ethoxylated alkyl phenol in an amount from about 0.1 to about 15 PBW; and (c) an ethoxylated and propoxylated alkyl phenol in an amount from about 1 to about 15 PBW;

wherein the sum of (a), (b) and (c) equals 100%.

In particular, the invention is concerned with the combination of a 1:1 ratio of ethoxylated (5 ethoxy units) octyl phenol and ethoxylated (7 ethoxy units) octyl phenol. The nonyl phenol could be used with only slight increase in foam. The compositions are useful in solid or liquid state as is further described below.

DETAILED DESCRIPTION OF INVENTION

The alkaline portion (a) of the low temperature low foaming cleaner composition contains at least 75 PBW of the cleaner composition and may contain up to 90–95 PBW.

Ethoxylated alkyl phenols are used to lower the surface tension of alkaline cleaners. The alkyl phenols that are employed are nonionic surfactants. The alkyl group can be from 6 to 12 carbon atoms, preferably $C_8$ and $C_9$. The ethoxylated portion generally has from 4 to 18 ethoxylated units, preferably 5 to 7 units. Most preferably, the ethoxylated alkyl phenol is a combination of two alkylated phenols. Preferably, the phenol is a combination of 5 ethoxy units of an alkylated phenol and 7 ethoxy units of an alkylated phenol on a 0.5–2:1 weight ratio, preferably a 1:1 ratio. The total ethoxylated alkyl phenol that is used in solids ranges from about 0.1 to 15 PBW of the cleaner composition.

The preparation of ethoxylated and/or propoxylated alkyl phenols are well known in the trade. Condensation reactions between phenols and ethylene oxide and/or propylene oxide are conducted until the desired ethoxylation or propoxylation is obtained. It is to be appreciated that these condensation reactions result in products that have mixtures of each of the oxide components.

In order to obtain the desirable low temperature low foaming properties of the cleaner composition, it has been found most desirable that an improved nonionic alkylated phenol be used. The material that is employed is an ethoxylated and propoxylated alkyl phenol, where the number of ethoxylated units ranges from 3 to 18, while the number of propoxylated units ranges from 3 to 18, preferably 4 to 14 ethoxylated units and 8 to 18 propoxylated units. The weight ratio of the ethoxylated and propoxylated alkyl phenol ranges from about 1 to about 15% of the cleaner composition. The sum of components (a), (b) and (c) equals 100% by weight.

It is to be appreciated that other components are added to the composition depending upon the end use of the cleaner. In some cases it is found that the metal to be treated may corrode and therefore the cleaner composition may have an anti-corrosive material present therein. Any variety of anti-corrosive materials may be employed, such as amines, borates, nitrites and the like, preferably sodium nitrite.

The cleaner composition is applicable towards any of the normal metallic substrates employed in industry, such as iron, zinc, aluminum, stainless steel, brass, copper and the like substrates.

The cleaner composition is preferably used to remove a wide variety of materials as oils and soaps that are built up on the metal during manufacturing processes which manipulate the metals. Examples of such oils are paraffinic oils, sulfurized oils, chlorinated sulfonated oils and the like. The soaps are those that are well known in the trade which are used during a drawing process to prepare metallic components.

A particular advantage of the present invention is not only the low foaming properties of the composition, but also the low temperature of its operability, that is, a temperature as low as 60° F. (15.6° C.) for operability. While the upper limit of cleaning temperature is the boiling point of the liquid cleaner, generally the upper temperature is about 212° F. (100° C.).

Frequently, the low temperature low foaming alkaline cleaner composition of the present invention is supplied on a dry solid basis. The end user takes a portion of the solid and mixes it with water by stirring and sprays it onto the substrate to obtain the necessary cleaning. The amount of the solid cleaner composition that is mixed with the water ranges from about 0.1 to about 20% by weight of the total aqueous composition.

Some industries, however, desire that liquid compositions be used as cleaners rather than having to manipulate dry products. In that situation, the present invention is also concerned with an aqueous composition. When the components of the low temperature low foaming alkaline cleaner composition is to be shipped in an aqueous medium, the use of a surfactant suspending agent is employed. It has been found particularly desirable to maintain the stability of the aqueous cleaner composition that a suspending agent, e.g., a high molecular weight carboxy vinyl polymer, be employed. The suspending agent that is employed is an effective amount, preferably ranging from about 0.1 to 5 PBW, more preferably 0.2 to 1 PBW, and even more preferably 0.2 to 0.6 PBW of the aqueous cleaner composition. The suspending agent maintains all of the surfactants in the cleaner compositions together to prevent separation therefrom. The suspending agent is an acrylic acid polymeric material generally available to the trade under the name Carbopol 914 (trademark of B. F. Goodrich for a high molecular weight carboxy vinyl polymer of the anionic type). When an aqueous system is employed as a shipping medium for the alkaline cleaner, the amount of water that is used ranges from about 25 to 65% of the cleaner composition. The cleaner composition is then considered a concentrate by the user, who in turn dilutes the aqueous cleaner concentrate composition such that there would be 0.5 to 10 parts of the cleaner concentrate per 100 parts of water. The cleaner composition is then sprayed in a manner very similar to that described above relating to the dry composition.

The aqueous solutions of the present invention when supplied to the consumer as a concentrate or when in use have an alkaline pH generally greater than 10, preferably 11.5–12.5 although concentrate has higher pH, e.g., 13.

Having now described the invention in general, recited below are preferred embodiments wherein all parts are parts by weight and all temperatures are in degrees Centigrade unless otherwise indicated. In all the examples recited below, a soiled metallic substrate was sprayed with the cleaner composition at a rate of 1.5 parts cleaner per 100 parts of water with satisfactory cleaning of an oiled steel substrate. The liquid was sprayed at the pressure (gauge) and temperature indicated for about 30 seconds. Percent clean is determined visually.

EXAMPLE 1

A medium duty silicated cleaner with low foam properties was formulated as follows:

| | |
|---|---|
| 26.0% | Sodium Carbonate |
| 22.0% | Tetrasodium Pyrophosphate, Anhydrous |
| 48.0% | Sodium Metasilicate, Hydrated |
| 2.6% | Anatrox LF-222 |
| 0.7% | Igepal CA-520 |
| 0.7% | Igepal CA-620 |

Oil on Steel Panel:
Sulfurized Oil: 100% clean at 90° F., 5 psi
SAE-90: 95% clean at 110° F., 5 psi

EXAMPLE 2

A non-phosphated inhibiting cleaner for operation at 80°–90° F. was formulated as follows:

| | |
|---|---|
| 26.0% | Sodium Hydroxide |
| 20.0% | Sodium Carbonate |
| 37.0% | Sodium Metasilicate, Anhydrous |
| 10.0% | Sodium Nitrite |
| 6.0% | Antarox LF-222 |
| 0.5% | Igepal CA-520 |
| 0.5% | Igepal CA-620 |

Oil on Steel Panel:
Sulfurized Oil: 100% clean at 78° F., 10 psi
SAE-90: 100% clean at 78° F., 10 psi

EXAMPLE 3

A non-silicated inhibiting cleaner for operation at 80°–90° F. was formulated as described below:

| | |
|---|---|
| 26.0% | Sodium Hydroxide |
| 27.0% | Sodium Carbonate |
| 30.0% | Sodium Tripolyphosphate |
| 10.0% | Sodium Nitrite |
| 6.0% | Antarox LF-222 |
| 0.5% | Igepal CA-520 |
| 0.5% | Igepal CA-620 |

Oil on Steel Panel:
SAE-90: 100% clean at 80° F., 10 psi

EXAMPLE 4

A medium to heavy duty alkaline cleaner for operation at 80°–90° F. was formulated as described below:

| | |
|---|---|
| 40.4% | Sodium Hydroxide |
| 42.4% | Sodium Carbonate |
| 5.0 | Disodium Phosphate, Anhydrous |
| 10.0% | Tetrasodium Pyrophosphate, Anhydrous |
| 1.2% | Antarox LF-222 |
| 0.5% | Igepal CA-520 |
| 0.5% | Igepal CA-620 |

Oil on Steel Panel:
Paraffin Oil: 100% clean at 70° F., 10 psi
Sulfurized Oil: 100% clean at 80° F., 10 psi
SAE-90: 100% clean at 70 F., 10 psi
The above formulation was used to clean a soiled cold rolled steel substrate at 60° F. with good cleaning results.

EXAMPLE 5

A low temperature cleaner was formulated as follows:

| | |
|---|---|
| 21.0% | Kasil #1 |
| 21.0% | Silicate N |
| 5.0% | Potassium Hydroxide |
| 15.0% | Tetrapotassium Pyrophosphate |
| 0.4% | Carbopol 941 |
| 3.0% | Antarox LF-222 |
| 0.2% | Igepal CA-520 |
| 0.2% | Igepal CA-620 |
| 34.2% | Water |

EXAMPLE 6

A low temperature non-phosphate cleaning composition was formulated as follows:

| | |
|---|---|
| 19.00% | Kasil #1 |

-continued

| | |
|---|---|
| 19.00% | Silicate N |
| 15.00% | Potassium Hydroxide |
| 0.50% | Carbopol 941 |
| 2.50% | Antarox LF-222 |
| 0.25% | Igepal CA-520 |
| 0.25% | Igepal CA-620 |
| 43.50% | Water |

EXAMPLE 7

An inhibited low temperature cleaner was formulated as follows:

| | |
|---|---|
| 19.0% | Kasil #1 |
| 19.0% | Silicate N |
| 5.0% | Potassium Hydroxide |
| 15.0% | Tetrapotassium Pyrophosphate |
| 5.0% | Sodium Nitrite |
| 0.4% | Carbopol 941 |
| 3.0% | Antarox LF-222 |
| 0.2% | Igepal CA-520 |
| 0.2% | Igepal CA-620 |
| 33.2% | Water |

The cleaning results of Examples 5–7 are that they clean equivalently to the powdered equivalent in cleaning SAE-90 oil at 80° F.

INDEX FOR EXAMPLES 1–7

Antarox LF-222 is a propylene oxide (average 13 propoxy units) capped ethoxylated nonyl phenol (trademark of GAF Corporation).

Igepal CA-520 is an octylphenoxypoly (ethyleneoxy) ethanol of a nonionic type being a liquid with an HLB index of 10.00 (trademark of GAF Corporation).

Igepal CA-620 is octylphenoxypoly (ethyleneoxy) ethanol of a nonionic type being a liquid with an HLB index of 12.00 (trademark of GAF Corporation).

Kasil #1 is potassium silicate having 8.3% $K_2O$; 20.8% $SiO_2$ and weight ratio $SiO_2/K_2O$ of 2.5 (trademark of Philadelphia Quartz Co.).

I claim:

1. A low temperature low foaming alkaline cleaning composition comprising:

(a) an alkaline portion containing at least 75% by weight (PBW) of the composition selected from the group consisting of alkali or alkaline earth metal borate, silicate, carbonate, hydroxide, phosphate and mixtures thereof;

(b) an ethoxylated alkyl phenol in an amount from about 0.1 to about 15 PBW containing 4 to 14 ethoxy units and 6 to 12 carbon atoms in the alkyl group; and (c) an ethoxylated and propoxylated alkyl phenol in an amount from about 1 to about 15 PBW containing 4 to 14 ethoxy units; 3 to 18 propoxy units and 6 to 12 atoms in the alkyl group; wherein the sum of (a), (b) and (c) equals 100 PBW.

2. The composition of claim 1 wherein component (b) is a mixture of ethoxylated alkyl phenols consisting predominantly of compounds of 5 and 7 ethoxy units, wherein the ratio of the 5 and 7 unit portions ranges from 0.5–2:1.

3. The composition of claim 2 wherein the ethoxylated alkyl phenol mixture is on a 1:1 ratio.

4. The composition of claim 1 wherein the alkaline materials are selected from the group consisting of alkali or alkaline earth metal borates, silicates, carbonates, hydroxides, and mixtures thereof.

5. The composition of claim 1 further comprising an aqueous component containing from 25 to 65 PBW of the composition thereby forming a liquid concentrate and further containing a carboxy modified vinyl polymer, wherein the amount of vinyl polymer ranges from about 0.1 to 5 PBW of the total aqueous concentrate composition.

6. The composition of claim 1 further comprising an anti-corrosive agent in the amount of 1 to 15 PBW.

7. A method for cleaning soiled substrates comprising mixing the composition of claim 1 in an aqueous medium in an amount of 0.1 to 20 PBW of the dry component in the aqueous component; cleaning the substrate by applying the aqueous mixture to the soiled substrate and removing the cleaned substrate therefrom.

8. The method of claim 7 wherein the cleaning temperature employed ranges from about 60° F. to boiling of the composition.

9. The method of claim 8 wherein the substrate is selected from the group consisting of iron, aluminum, stainless steel, copper, brass and zinc substrates.

10. A method of cleaning soiled substrates comprising mixing the concentrate cleaner composition of claim 5 with an aqueous medium in an amount of 0.5 to 10 PBW of the concentrate in the aqueous medium, cleaning the substrate by applying the aqueous cleaner mixture to the soiled substrate and removing the cleaned substrate.

11. The method of claim 10 wherein the temperature employed ranges from about 60° F. to the boiling point of the cleaner composition.

12. The method of claim 11 wherein the substrate cleaned is selected from the group consisting of copper, brass, stainless steel, zinc, aluminum and iron.

13. An aqueous cleaner bath for cleaning metallic substrates comprising the cleaning composition of claim 1 in an amount of about 0.1 to about 20 PBW in water.

14. An aqueous cleaner bath for cleaning metallic substrates comprising the cleaning composition of claim 5 in an amount of about 0.5 to about 10 PBW in water.

15. The composition of claim 1 wherein the alkaline materials are selected from the group consisting of alkali or alkaline earth metal borates, carbonates, hydroxides, phosphates and mixtures thereof.

* * * * *